US007793872B2

(12) United States Patent
Watzelt et al.

(10) Patent No.: US 7,793,872 B2
(45) Date of Patent: Sep. 14, 2010

(54) DEVICE FOR COMMINUTING ALL TYPES OF PARTS

(75) Inventors: Holger Watzelt, Neckargemund-Dilsberg (DE); Karlheinz Herbold, Meckesheim (DE)

(73) Assignee: Herold Meckesheim GmbH, Meckesheim (DE)

( * ) Notice: Subject to any disclaimer, the term of this patent is extended or adjusted under 35 U.S.C. 154(b) by 0 days.

(21) Appl. No.: 12/162,111

(22) PCT Filed: Jan. 8, 2007

(86) PCT No.: PCT/DE2007/000030

§ 371 (c)(1),
(2), (4) Date: Jul. 24, 2008

(87) PCT Pub. No.: WO2007/085221

PCT Pub. Date: Aug. 2, 2007

(65) Prior Publication Data

US 2009/0050724 A1 Feb. 26, 2009

(30) Foreign Application Priority Data

Jan. 24, 2006 (DE) ..... 10 2006 003 529

(51) Int. Cl.
*B02C 19/00* (2006.01)

(52) U.S. Cl. ..... 241/99; 241/186.5; 241/225

(58) Field of Classification Search ..... 241/186.5, 241/99, 222, 224, 225
See application file for complete search history.

(56) References Cited

U.S. PATENT DOCUMENTS

| | | | | |
|---|---|---|---|---|
| 850,988 | A | 4/1907 | Williams | |
| 2,128,194 | A * | 8/1938 | Sheldon | 241/89.3 |
| 4,037,799 | A * | 7/1977 | Urban | 241/186.5 |
| 4,205,794 | A * | 6/1980 | Horton et al. | 241/73 |
| 4,932,595 | A * | 6/1990 | Cohen et al. | 241/99 |

FOREIGN PATENT DOCUMENTS

| | | | |
|---|---|---|---|
| DE | 35 17 684 | A1 | 11/1986 |
| DE | 296 10 848 | U1 | 10/1996 |
| WO | WO 2004/016356 | A | 2/2004 |

OTHER PUBLICATIONS

International Search Report, PCT/DE2007/000030 dated Sep. 17, 2007.
Written Opinion, PCT/DE2007/000030 dated Sep. 17, 2007.

* cited by examiner

*Primary Examiner*—Mark Rosenbaum
(74) *Attorney, Agent, or Firm*—Henry B. Ward, III; Moore & Van Allen

(57) ABSTRACT

The invention relates to a device for comminuting all types of parts, in particular plastics, preferably hollow plastic bodies, such as for example plastic bottles. The device comprises a feeding device, and a comminuting unit, the feeding device having at least one transport unit and the comminuting unit having a rotor, which is provided with tools and rotates in a housing. The device is characterized in that the transport unit transports the parts at an angle of between 45° and 90° to the rotor axis, at least in the region lying directly in front of the rotor.

24 Claims, 3 Drawing Sheets

DEVICE FOR COMMINUTING ALL TYPES OF PARTS

FIELD OF THE INVENTION

The invention relates to an apparatus for comminuting all types of parts, in particular plastics, preferably plastic hollow bodies, such as plastic bottles for example, having a feeding device and a comminuting device, the feeding device comprising at least one conveyor unit and the comminuting device comprising a rotor which is fitted with tools and rotates inside a housing.

BACKGROUND OF THE INVENTION

Apparatuses of the generic type have been known in practice for years in the most varied embodiments. In this respect, reference is made merely by way of example to DE 38 13 879. In concrete terms, the apparatus known there is a comminuting machine for thermoplastic waste. The material to be ground is delivered via a funnel and passes directly from the funnel via a conveyor unit into the actual mill, which comprises a rotor rotating in a housing. The feeding device or the conveyor unit is designed as a screw. The rotation axes of screw and rotor run parallel to one another, such that the material to be ground passes via the screw on the head side to the rotor and has to be seized there by the latter. This is problematic especially at higher rotary speeds, since light material to be ground, in particular material to be ground consisting of plastic hollow bodies, especially tends to be repulsed by the rotary movement of the rotor. The conveying of the material to be ground into the rotor is therefore extremely problematic. In addition, when material to be ground is conveyed into the region of the rotor in the known manner, it has been found that quite considerable acoustic emissions occur, which always have to be reduced.

The object of the present invention is therefore to configure and develop an apparatus for comminuting all types of parts, in particular plastics, preferably plastic hollow bodies, such as plastic bottles for example, in such a way that material is received in a sufficiently effective manner in the region of the rotor and that in fact the material to be ground can be easily conveyed into the region of the rotor. Working noises are to be reduced.

SUMMARY OF THE INVENTION

The present invention provides an apparatus for comminuting all types of parts, in particular plastics, preferably plastic hollow bodies, such as plastic bottles for example, having a feeding device and a comminuting device, the feeding device comprising at least one conveyor unit and the comminuting device comprising a rotor which is fitted with tools and rotates inside a housing, and wherein the conveyor unit conveys at an angle within the range of between 45° and 90° to the rotor axis, at least in the region directly in front of the rotor. In one embodiment, the conveyor unit conveys overall at an angle within the range of between 45° and 90° to the rotor axis. In another embodiment, the conveyor unit conveys at an angle of about 90° to the rotor axis. In one embodiment, a plurality of conveyor units are provided. In another embodiment, the conveyor units are provided according to the width of the comminuting device, such that the comminuting device can be fed over its entire width. In yet another embodiment, the conveyor units are arranged equidistantly from one another. In still another embodiment, the conveyor units run parallel to one another. In another embodiment, the conveyor units are arranged obliquely relative to one another, preferably at an acute angle to one another. In other embodiments, the conveyor units lie essentially in one plane or lie in different planes. In still other embodiments, the conveyor units are arranged essentially horizontally or are arranged essentially perpendicularly. In one embodiment, the conveyor units are arranged at an angle of between 0° and 180° to the horizontal. In another embodiment, the conveyor units are directly in alignment with the rotor axis. In still another embodiment, the longitudinal axes of the conveyor units run offset from the rotor axis.

In one embodiment, the conveyor unit is designed as a conveyor screw. In another embodiment, a plurality of conveyor screws are provided as conveyor units, and in that the conveyor screws act relative to one another in such a way that they have a behavior which draws in the material to be conveyed. In one embodiment, the conveyor screws rotate in the same direction. In another embodiment, the conveyor screws rotate in opposite directions. In yet another embodiment, the conveyor screws are mounted in a floating manner. In other embodiments, the conveyor screws are mounted on both sides, i.e. with an abutment in each case. In one embodiment, the rotary speed of the conveyor screws is controlled preferably while taking into account the load input of the drive. In another embodiment, the conveyor screws are rotatable in reverse via a reversing control. In yet another embodiment, the conveyor screws are fitted at least partly with tools. In one embodiment, the tools are designed as blades and/or ripping teeth.

In still another embodiment, the apparatus comprises a funnel for delivering the material to be ground is incorporated ahead of the conveyor unit.

In yet another embodiment, the comminuting device is designed as a cutting mill, a hammer mill or a shredder.

BRIEF DESCRIPTION OF THE SEVERAL VIEWS OF THE DRAWINGS

Figure 1:
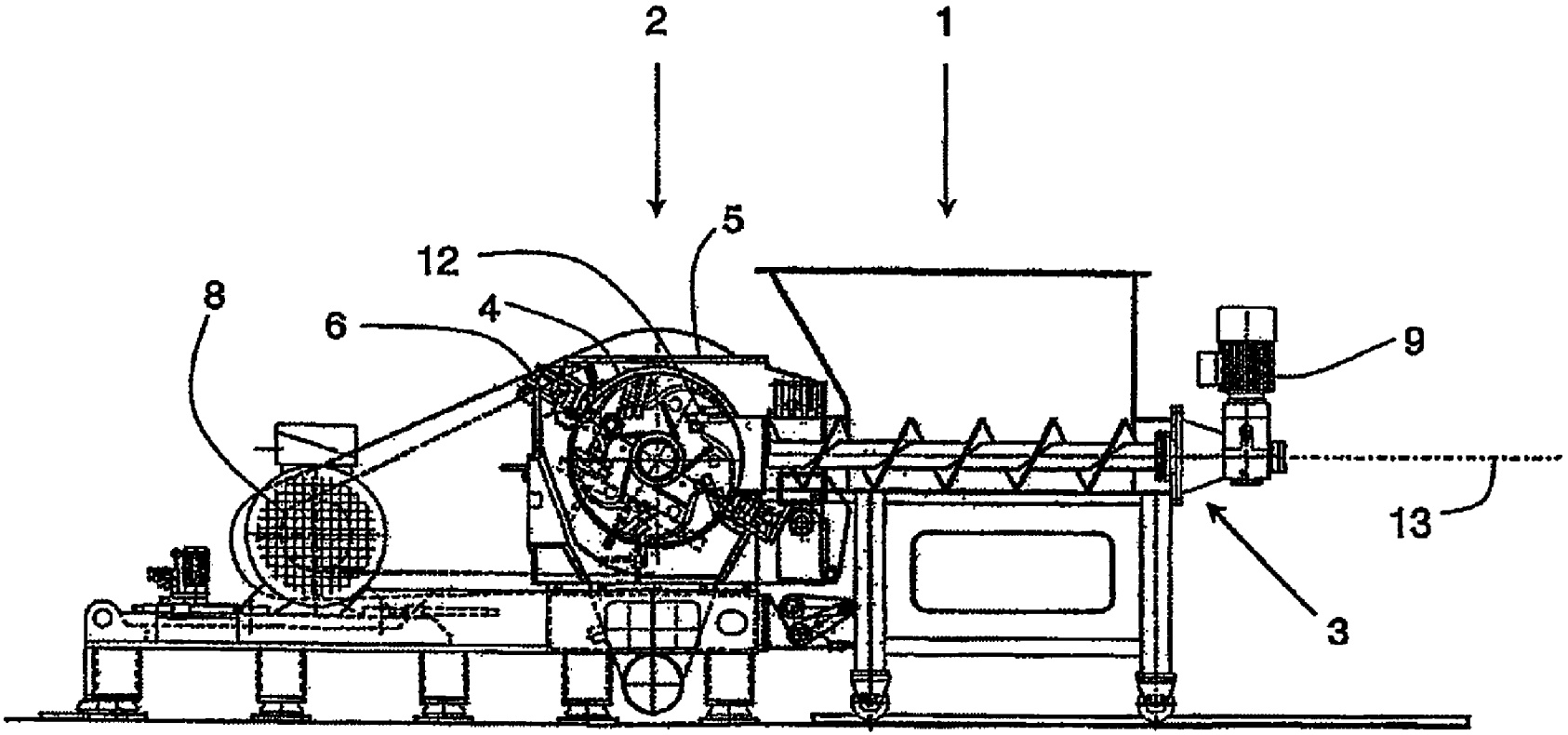
Figure 2:
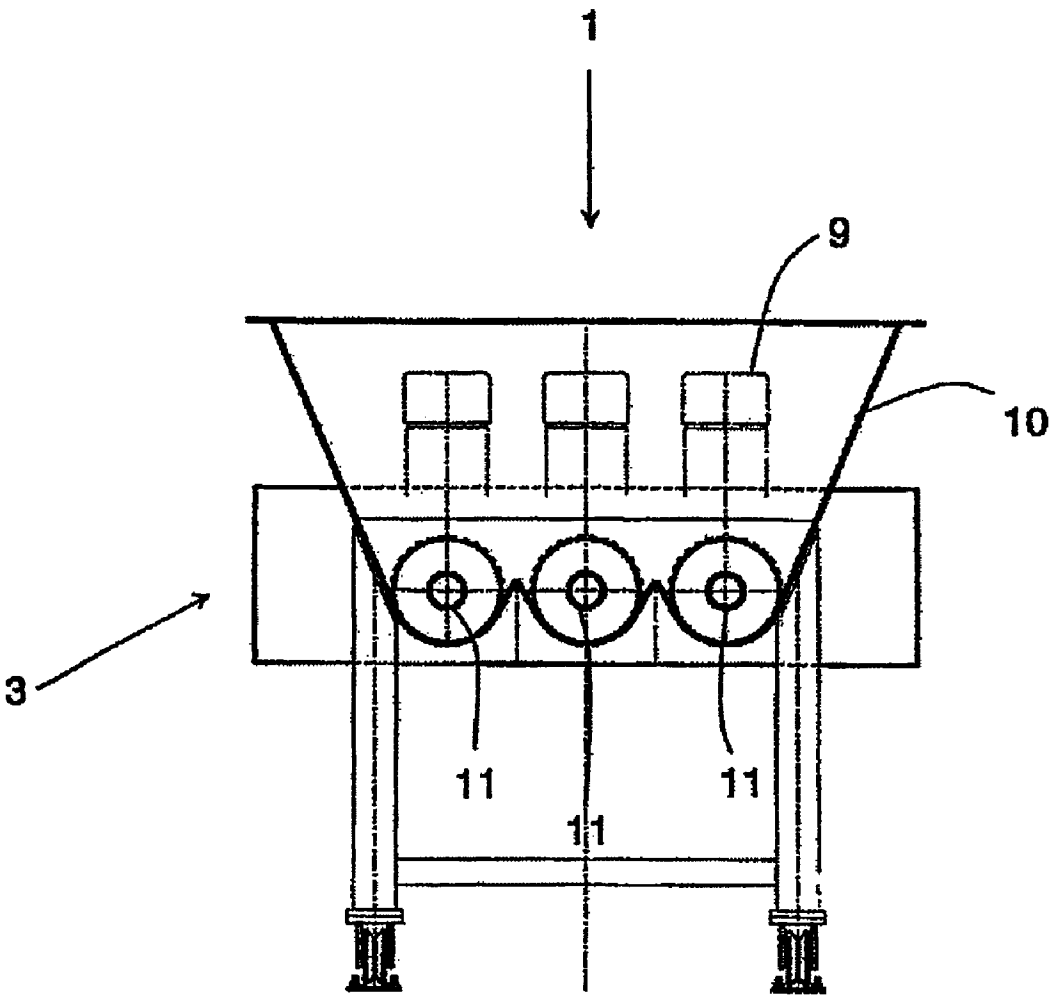
Figure 3:
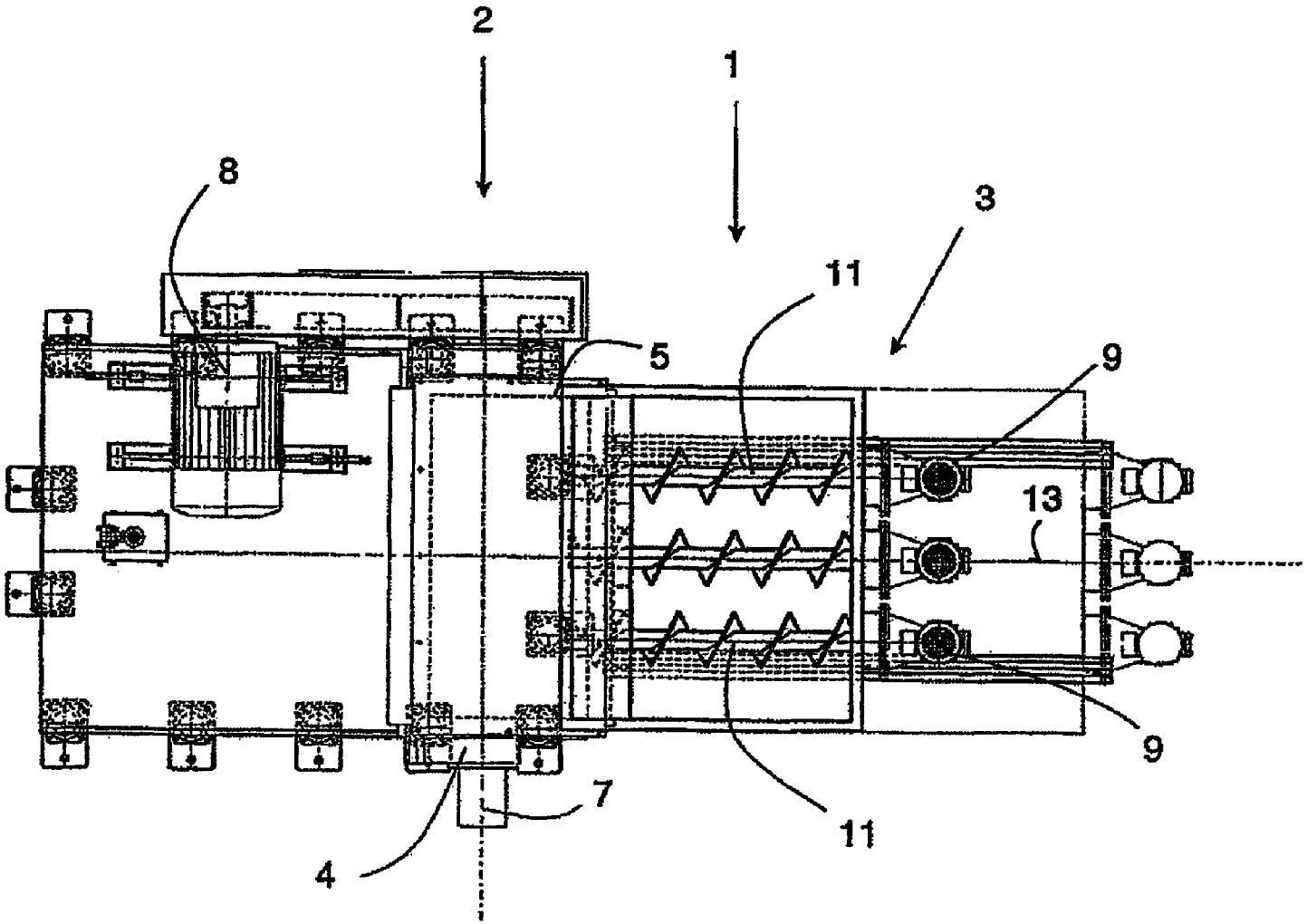

Having thus described the invention in general terms, reference will now be made to the accompanying drawings, which are not necessarily drawn to scale, and wherein:

FIG. 1 shows an exemplary embodiment of an apparatus according to the invention in a schematic side view;

FIG. 2 shows the subject matter from FIG. 1 in cross section through the feeding device; and FIG. 3 shows the subject matter from FIG. 1 in a schematic plan view.

DETAILED DESCRIPTION OF THE INVENTION

The above object is achieved according to the invention by the features of patent claim 1. Accordingly, the apparatus in question is characterized in that the conveyor unit conveys at an angle within the range of between 45° and 90° to the rotor axis, at least in the region directly in front of the rotor.

In a manner according to the invention, it has first of all been recognized that the problems discussed above can be reduced by deviating from the proven parallel arrangement of conveying axis and rotation axis of the rotor, namely by the conveyor unit conveying at an angle within the range of between 45° and 90° to the rotor axis, at least in the region directly in front of the rotor. This has the advantage that the material to be ground is especially not conveyed parallel to the rotary movement of the rotor in the region of the latter, as a result of which material to be ground is regularly repulsed and thus considerable noise emission occurs. In complete contrast thereto, a completely different method of feeding is selected here, namely at an angle within the range of between 45° and 90° to the rotor axis, preferably at an angle of about 90° to the rotor axis. In a preferred manner, the material to be ground is accordingly conveyed orthogonally to the rotation axis of the rotor, such that the material to be ground can be picked up in an ideal manner in accordance with the configuration of the rotor and the configuration of the housing arranged around it, namely in accordance with the provision and arrangement of the blades and/or cutting teeth.

A plurality of conveyor units are advantageously provided, such that the material to be ground can be conveyed parallel to the rotor, namely according to the width of the comminuting device. In this case, the material to be ground can be conveyed over the entire width of the comminuting device and fed to the comminuting device. This results in quite considerable throughput.

In an advantageous manner, the conveyor units are arranged equidistantly from one another. In a further advantageous manner, the distances between the individual conveyor units can be varied. A special adjusting mechanism can be provided for this purpose.

In principle, it is conceivable for the conveyor units to run parallel to one another. However, it is likewise conceivable for the conveyor units to run obliquely relative to one another, preferably at an acute angle to one another. In this case, a voluminous material to be ground, for example PET bottles, could already be at least partly compressed or deformed or even torn up when being conveyed.

The conveyor units may be arranged essentially in one plane. If it is desired that force already be applied to the material to be ground during the conveying, it may also be advantageous to arrange the conveyor units in different planes relative to one another, in such a way as to run as obliquely as possible relative to one another.

With regard to the conveying of the material to be ground, it is possible to arrange the conveyor units essentially horizontally. It is likewise conceivable to feed the material to be ground vertically or at any desired angle between 0° and 180° to the horizontal of the comminuting device, to be precise as required. Care should be taken here to ensure that the conveyor unit has the requisite angle within the range of between 45° and 90° to the rotor axis, at least in the region directly in front of the rotor.

It has been found that the material is received in the region of the comminuting device especially effectively when the longitudinal axes of the conveyor units are directly in alignment with the rotor axis or at most run slightly offset from the rotor axis. In this case, the conveying distance can be subdivided into various conveying sections, such that the material to be ground can be turned in direction over the conveying distance.

From a constructional point of view, it is advantageous if the conveyor unit is designed as a conveyor screw. A plurality of conveyor screws may be provided as conveyor units. In this case, the conveyor screws should act relative to one another in such a way that they have a behavior which draws in the material to be conveyed. Accordingly, the direction of rotation and the configuration of the conveyor screws are to be matched to one another.

According to the practical configuration of the conveyor screws, said conveyor screws may rotate in the same direction or else in opposite directions. The conveyor screws may be mounted in different ways, thus, for example, in a floating manner or on both sides with an abutment in each case.

In particular with regard to a trouble-free comminution process with optimum throughput, it is advantageous if the rotary speed of the conveyor screws is controlled preferably while taking into account the load input of the drive. In addition, a comprehensive sensory system may be provided which influences the rotary speed while taking into account other factors.

The conveyor screws can be fitted at least partly with tools, it being possible for the tools of the conveyor screws to be designed as blades and/or ripping teeth. The provision of ripping teeth serves to separate cohesive parts and helps to break down entire bundles of material.

With regard to trouble-free operation, it is a further advantage if the conveyor screws are rotatable in reverse via a reversing control. As a result, obstructions can easily be removed.

Furthermore, it may be mentioned that the material to be ground can be fed to the conveyor unit in any desired manner. With regard to an especially simple configuration, a funnel for delivering the material to be ground is incorporated ahead of the conveyor unit. Any other desired configurations for the purpose of delivering the material to be ground can be realized.

In principle, the comminuting unit may be designed in very different ways, thus, for example, as a cutting mill, a hammer mill, a shredder, etc. Different further configurations, in particular in detail, are conceivable.

In light of the above explanations, it can be emphasized that the apparatus according to the invention is especially suitable in particular for comminuting light materials, preferably for comminuting plastic hollow bodies. This can be attributed not least to the better receiving of material in the region of the comminuting device. On account of the better arrangement of the feeding device relative to the direction of rotation of the rotor, not only is the receiving of material assisted but in particular acoustic emissions are also reduced. A further advantage can be seen in the fact that the delivery height in the apparatus according to the invention is smaller than in conventional comminuters, thereby making it easier to place or install the apparatus in a production region.

There are, then, various possibilities of configuring and developing the teaching of the present invention in an advantageous manner. To this end, reference is made firstly to the patent claims which are subordinate to patent claim 1 and secondly to the explanation below of a preferred exemplary embodiment of the invention with reference to the drawing. In conjunction with the explanation of the preferred exemplary embodiment of the invention with reference to the drawing, preferred configurations and developments of the teaching are also generally explained.

FIGS. 1 to 3 show an exemplary embodiment of an apparatus according to the invention for comminuting all types of parts, wherein in concrete terms this apparatus is one for comminuting plastic hollow bodies, which are not shown in the figures. Plastic bottles, such as PET bottles for example, are regularly comminuted using such an apparatus. The apparatus comprises a feeding device 1 and a comminuting device 2. In the exemplary embodiment shown here, the feeding device 1 comprises a total of three conveyor units 3. The comminuting device 2 comprises a rotor 4 which is fitted with tools and rotates inside a housing 5. The housing 5, often also designated as stator, is likewise provided with tools 6.

FIGS. 1 to 3 together show that the conveyor unit 3 conveys orthogonally to the rotor axis 7, an arrangement within the range of between 45° and 90° to the rotor axis 7 being possible in a manner according to the invention.

Furthermore, the figures show a drive 8 of the rotor and drives 9 of the conveyor units 3. The drives 8, 9 are independent of one another, it being advantageous to synchronize the drives 9 of the conveyor units 3.

The material to be ground is delivered via a funnel 10 and is seized by the conveyor units 3 in the bottom region of the funnel 10, said conveyor units 3 running parallel to and equidistantly from one another in one plane or extending toward the comminuting device 2. The conveyor units 3 are designed as conveyor screws 11.

Over the full width of the three conveyor screws 11 working side by side, the material to be ground is conveyed to the rotor 4 extending orthogonally to the conveyor screws 11 and is seized by the tools 12 there and ground. On account of the tools 6 of the housing 5, the piece material is already compressed and/or separated, such that it passes with reduced volume into the region of the rotor 4 and can be comminuted or shredded there by the tools 12.

Furthermore, the figures show that the rotor axis 7 lies approximately in the same plane as the rotation axis 13 of the conveyor screws 11. This results in an extremely small overall height, it being possible by means of the design features to generate considerable throughput, and this with a substantially smaller delivery height into the comminuter than in conventional equipment of the generic type.

With regard to the features which can be seen from the figures, reference is made to the general part of the description in order to avoid repetitions.

Finally, it may be noted that the exemplary embodiment discussed above merely serves to discuss the claimed teaching by way of example, but this is not restricted to the exemplary embodiment.

The invention claimed is:

1. An apparatus for comminuting plastic hollow bodies comprising a feeding device and a comminuting device, said feeding device comprising a plurality of conveyor units and said comminuting device comprising a rotor, a housing, and at least one tool, wherein said rotor defines a rotor axis and wherein said rotor is fitted with said at least one tool and is configured to rotate inside said housing about said rotor axis, wherein said plurality of conveyor units defines a first width across which said plurality of conveyer units conveys the plastic hollow bodies to said rotor, and wherein said plurality of conveyer units conveys the plastic hollow bodies to said rotor at an angle within the range of between 45° and 90° to said rotor axis, at least in the region of said first width directly in front of said rotor, wherein at least two of said plurality of conveyor units lie in different planes.

2. The apparatus as claimed in claim 1, wherein said plurality of conveyor units conveys the plastic hollow bodies to said rotor at an angle of about 90° to said rotor axis.

3. The apparatus as claimed in claim 1, wherein said comminuting device defines a second width, said second width interfacing with said feeding device, and wherein said plurality of conveyor units are arranged along said second width such that said comminuting device can receive the plastic hollow bodies from said feeding device over the entirety of said second width.

4. The apparatus as claimed in claim 3, wherein said plurality of conveyor units are arranged equidistantly along said second width.

5. The apparatus as claimed in claim 3, wherein said plurality of conveyor units are arranged parallel to one another.

6. The apparatus as claimed in claim 3, wherein said plurality of conveyor units are arranged obliquely relative to one another.

7. The apparatus as claimed in claim 3, wherein at least two of said plurality of conveyor units lie essentially in one plane.

8. The apparatus as claimed in claim 3, wherein said plurality of conveyor units are arranged horizontally.

9. The apparatus as claimed in claim 3, wherein said plurality of conveyor units are arranged vertically.

10. The apparatus as claimed in claim 3, wherein said plurality of conveyor units are arranged at an angle between 0° and 180° to the horizontal.

11. The apparatus as claimed in claim 1, wherein at least one of said plurality of conveyer units defines a longitudinal axis, said longitudinal axis being directly in alignment with said rotor axis.

12. The apparatus as claimed in claim 1, wherein at least one of said plurality of conveyer units defines a longitudinal axis, said longitudinal axis being offset from said rotor axis.

13. The apparatus as claimed in claim 1, wherein at least one of said conveyor units comprises a conveyor screw.

14. The apparatus as claimed in claim 13, wherein said conveyor screw comprises first and second ends, and wherein said conveyer screw is mounted in a floating manner such that said first end is mounted and said second end is unattached.

15. The apparatus as claimed in claim 13, wherein said conveyor screw comprises first and second ends and said corresponding conveyer unit comprises first and second abutments, and wherein said first end is mounted on said first abutment and said second end is mounted on said second abutment.

16. The apparatus as claimed in claim 13, wherein said comminuting device further comprises a drive element, and wherein the rotary speed of said conveyor screw is controlled while taking into account the load input of said drive element.

17. The apparatus as claimed in claim 13, wherein said conveyor screw is fitted with at least one tool.

18. The apparatus as claimed in claim 17, wherein said at least one tool comprises at least one of a blade or a ripping tooth.

19. The apparatus as claimed in claim 13, wherein said conveyor screw is rotatable in reverse.

20. The apparatus as claimed in claim 1, wherein said plurality of conveyor units comprise a plurality of conveyor screws, and wherein said plurality of conveyor screws act relative to one another in such a way as to draw in the plastic hollow bodies to be conveyed.

21. The apparatus as claimed in claim 20, wherein each of said plurality of conveyor screws rotates in the same direction.

22. The apparatus as claimed in claim 20, wherein at least two of said plurality of conveyor screws rotate in opposite directions.

23. The apparatus as claimed in claim 1, further comprising a funnel for receiving and delivering the plastic hollow bodies to said plurality of conveyor units.

24. The apparatus as claimed in claim 1, wherein said comminuting device comprises at least one of a cutting mill, a hammer mill or a shredder.

* * * * *